US009476433B2

(12) United States Patent
Jang

(10) Patent No.: US 9,476,433 B2
(45) Date of Patent: Oct. 25, 2016

(54) ROTARY ACTUATOR

(71) Applicant: SH PAC Co., Ltd., Busan (KR)

(72) Inventor: YoungKyu Jang, Gimhae-si (KR)

(73) Assignee: SH PAC Co., Ltd. (KR)

( * ) Notice: Subject to any disclaimer, the term of this patent is extended or adjusted under 35 U.S.C. 154(b) by 332 days.

(21) Appl. No.: 14/223,451

(22) Filed: Mar. 24, 2014

(65) Prior Publication Data

US 2015/0267722 A1 Sep. 24, 2015

(51) Int. Cl.

| | |
|---|---|
| ***F15B 15/06*** | (2006.01) |
| ***F15B 15/08*** | (2006.01) |
| *F15B 15/14* | (2006.01) |

(52) U.S. Cl.

CPC ..... *F15B 15/068* (2013.01); *F15B 15/088* (2013.01); *F15B 2015/1495* (2013.01); *F15B 2215/30* (2013.01)

(58) Field of Classification Search

CPC .... F15B 15/068; F15B 15/08; F15B 15/088; F15B 2215/30; F15B 2015/1495

USPC ..... 92/136; 74/570.3, 573.13, 594

See application file for complete search history.

(56) References Cited

U.S. PATENT DOCUMENTS

| | | | | |
|---|---|---|---|---|
| 4,906,161 A | | 3/1990 | Weyer | |
| 4,945,779 A | | 8/1990 | Williams | |
| 5,168,767 A | * | 12/1992 | Morita | F16H 25/2204 184/99 |
| 5,671,652 A | | 9/1997 | Weyer | |
| 6,173,938 B1 | * | 1/2001 | McAndrew | F15B 15/223 251/31 |
| 6,186,015 B1 | * | 2/2001 | Regueiro | F16H 25/2204 74/424.9 |
| 6,370,801 B1 | | 4/2002 | Weyer et al. | |
| 6,966,249 B2 | * | 11/2005 | Lee | A01D 46/20 92/31 |
| 7,930,971 B2 | | 4/2011 | Werkhoven | |
| 8,141,448 B2 | | 3/2012 | Watanabe et al. | |
| 8,955,432 B2 | * | 2/2015 | Kawagoe | G03F 7/00 101/287 |
| 2009/0095099 A1 | | 4/2009 | Konomoto | |
| 2010/0234967 A1 | | 9/2010 | Whiteley et al. | |

FOREIGN PATENT DOCUMENTS

| | | |
|---|---|---|
| KR | 10-2008-0122026 | 12/2008 |
| KR | 10-0929525 | 12/2009 |
| WO | WO 2010/022280 | 2/2010 |

* cited by examiner

*Primary Examiner* — Logan Kraft

(74) *Attorney, Agent, or Firm* — Roth Blair Roberts Strasfeld & Lodge

(57) ABSTRACT

A rotary actuator includes a piston and rod coaxially disposed in a tube. The piston is configured for lateral displacement along the rod. Moreover, the tube includes an inner circumferential surface with a bearing portion having spherical bearing pockets in rows. Each bearing pockets in the tube includes a mated bearing for engagement with a slant groove body portion on an outer circumferential surface of the piston. The slant groove body portion of the piston includes at least two spiral grooves with a helix direction. The piston further includes an inner circumferential surface with a second spherical bearing pocket portion to engage a spiral groove portion of the axial rod disposed through the piston. As a result, linear motion of the piston engages the axial rod and forces the axial rod to rotate, thereby driving a platform affixed at an end cap of the axial rod to rotate.

7 Claims, 12 Drawing Sheets

ROTARY ACTUATOR

FIELD OF THE INVENTION

This invention relates generally to an actuator and more particularly to a rotary actuator adapted for converting a linear input motion to a rotary output motion.

BACKGROUND

Rotary actuators are used in a variety of applications where it is desired to effect movement of a rotary fashion about a center-point. Such actuators are used, for example, to open and close valves, turn switches, operate steering mechanisms, etc. Moreover, rotary actuators are known and often used in practice with a platform of a special motor vehicle for lifting a person using a vertical mast lift or boom to work at high places, over and around electrical and telephone lines, duct work and trees during construction, to make repairs, and/or to do maintenance work.

The actuator may be of the double-action type, as in this case, wherein fluid, either hydraulic or pneumatic, is used to displace a piston in an oscillating manner in a chamber to effect rotation of an axial rod or shaft in a clockwise and counterclockwise direction, depending on movement of the attached piston. More specifically, a rotary helical grooved or splined actuator typically uses a cylindrical body with an elongated rotary output shaft extending coaxially within the body, with an end portion of the shaft providing the rotational drive output. An elongated, annular piston sleeve has a splined portion to engage between and cooperate with corresponding splines on an interior of the cylindrical body and an exterior of the output shaft. The piston sleeve is reciprocally mounted within the body and has a piston head portion for the application of fluid pressure to one or the other opposing sides to produce axial movement of the piston sleeve in the cylindrical body and along the output shaft.

In use, as the piston sleeve reciprocates linearly in the axial direction within the body, the outer helical splines of the piston sleeve engage helical splines of the body to cause rotation of the piston sleeve. As a result, linear and rotational movement of the piston sleeve is transmitted through the inner helical splines of the piston sleeve to the helical splines of the shaft that causes the shaft to rotate.

Accurate and efficient cutting of the mating helical grooves or splines across the interiors and exteriors of the piston sleeve, cylindrical body and axial shaft or rod, accordingly, can be difficult and expensive. As an alternative, U.S. Pat. No. 6,966,249 describes a rotary actuator using pins to engage the splines. Moreover, a first set of pins are positioned via passages through the piston sleeve to engage the splines on the exterior of the axial shaft, and a second set of pins are fixedly installed through holes in the cylindrical body to engage the helical splines of the piston. In operation, the first pins, fixed to the piston, are inserted in the slant grooves of the axial shaft, and the second pins fixed to the cylindrical body are inserted in the slant grooves or splines of the piston. Thus, with this coupling structure, when the piston moves, it rotates with respect to the cylindrical body and the axial rod or shaft is rotated with respect to the piston.

This approach is less efficient and more unreliable than the instant invention in that the through-hole openings in the cylinder body and reciprocating piston used to accommodate the first and second sets of pins, act as points of fatigue and ultimately leakage of hydraulic or pneumatic fluid; leading to premature failure of the actuator, particularly when used with heavy loads.

Korean Publication No. 2005-0018741 shows an alternative design eliminating the through-holes in the cylinder body, using instead bearings to travel along linear grooves aligned with the axis of the axial rod. However, this design is inferior to the instant invention, in that the rotation of the axial rod is simply subject to the slant angle of the splines or grooves of the axial rod (versus the combined helical angles of the splines of the axial rod and piston). Further, Korean Patent Application No. 2005-0018743 includes through-holes in the piston for a second set of pass-through bearings engaging both the linear grooves of the cylindrical body and helical grooves of the piston rod. This arrangement is prone to uneven wear of the bearings as each bearing is forced to rotate in a different direction caused by contact against the corresponding linear and helical grooved surfaces.

There is a need, therefore, for a rotary actuator capable of effectively and more efficiently supporting and rotating a heavy load repeatedly, without failure, in a confined and compact space. The object of the present invention is to solve the problems associated with the known arrangements at the least possible expense, so that large-scale production of an effective, efficient and durable actuator can be manufactured and maintained at an acceptable cost. Regarding the instant invention, the rotary actuator can be used to support a heavy structure such as a platform or a lifting arm. It can be installed easily in a small and/or confined space, being durable and efficient, without points susceptible to fatigue, leakage, undue wear per cycle, and other deficiencies prone with the existing actuators described above.

SUMMARY

In an exemplary embodiment of the present invention, the rotary actuator (100) comprising a tube (110) with end caps (150, 250) forming a working enclosure (102). The tube (110) includes first and second hydraulic ports (114) through which a fluid enters and is exhausted in the working enclosure (102). The tube (110) further includes an inner circumferential surface (116) with a bearing pocket portion (140). The bearing pocket portion (140) has a plurality of spherical bearing pockets (141) aligned in at least three rows with at least two bearing pockets per row (hereinafter referred to as the "tube pocket rows (TPR)"). Each tube pocket row (TPR) is helically aligned and equally spaced from the other a first distance about the axis of the tube (110).

Next, an axial shaft or rod (200) is attached and coaxially aligned inside the tube (110) for rotation. The axial rod (200) is fixed to one or both of the end caps (150, 250) disposed as a rotating platform (151 and/or 251). The axial rod (200) has an outer circumferential surface having a helical groove portion (220) with at least three helical or spiral grooves (223) formed at an incline or helix, and each groove (223) is preferably spaced an equal distance from adjacent grooves (223). A piston (300), disposed between the tube (110) and the axial rod (200), includes a slant groove body portion (320) on an outer circumferential surface with at least three helical or spiral grooves (323) having a helical direction opposite the spiral grooves (223) of the axial rod (200). The spiral grooves (323) of the piston (300) are spaced equal to the distance of the tubular pocket rows (TPR) for alignment therewith. Further yet, the piston (300) includes an inner circumferential surface (312) with a plurality of rows (hereinafter referred to as the "piston pocket rows (PPR)") having at least three spherical bearing pockets (341) per row. Each piston pocket row (PPR) is helically aligned and spaced from each other about the axis a distance equal to the distance of the spiral grooves (223) of the helical groove portion (220) of the axial rod (200), so that each piston pocket row (PPR) is correspondingly aligned with one of said spiral grooves (223).

Each of the first spherical bearing pockets (141) of the bearing pocket portion (140) of the tube (110) includes a bearing (142) for rotation therein and along the correspondingly aligned spiral groove (323) of the piston (300). Further, each of the second spherical bearing pockets (341) on the inner circumferential surface (312) of the piston (300), has a piston bearing (342) for rotation therein and along the correspondingly aligned spiral groove (223) of the axial rod (200). As a result of the inter-engagement of the spiral grooves (223, 323) with the corresponding sets of bearings (142, 342), the linear motion (LM) of the piston (300) forces the axial rod (200) to rotate, thereby rotating the platform(s) (151, 251) affixed thereto.

The scope of applicability of the preferred embodiment will become more apparent from the following detailed description, claims and drawings. It should be understood that the description and specific examples, although indicating preferred embodiments of the invention, are given by way of illustration only. Various changes and modifications to the described embodiments and examples will be apparent to those skilled in the art.

BRIEF DESCRIPTION OF THE DRAWINGS

The above and other features and advantages of the invention will become more apparent by describing in detail preferred embodiments with reference to the attached drawings in which.

DETAILED DESCRIPTION OF THE PREFERRED EMBODIMENT

Figure 6:
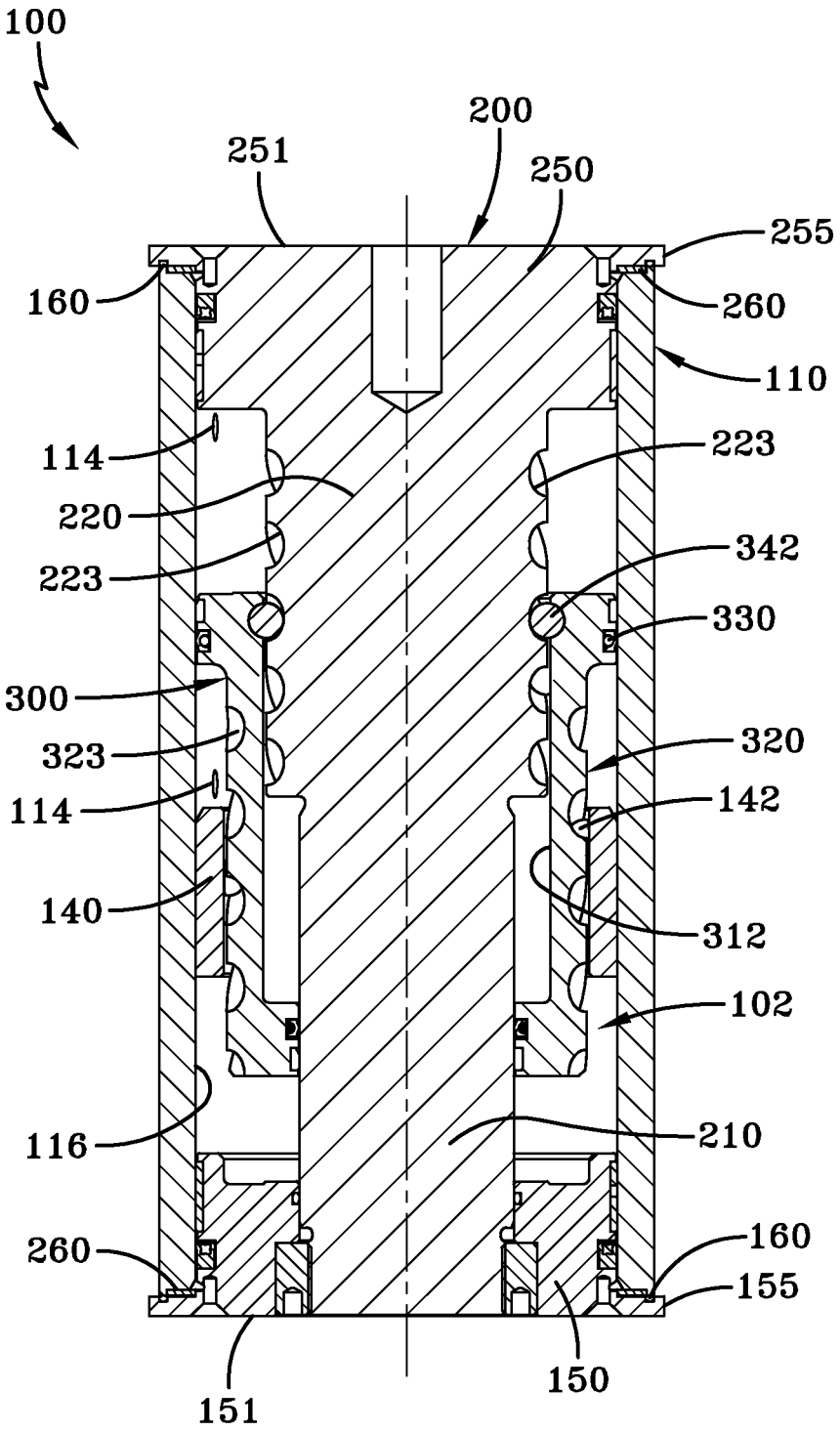
FIG. 6 is a cross-sectional view of the preferred embodiment of the actuator taken about the lines 6-6 of FIG. 3.

The preferred embodiment of the invention in this case is a rotary actuator (100) having a tube (110) with a cylindrical housing or body portion (112) coaxially aligned with a rotating axial rod (200) between first and second end caps (150, 250) to form a work enclosure (102) as shown in FIG. 6. With reference to the assembled and exploded views of FIG. 4A-4C, the working enclosure (102) includes a reciprocating sleeve used as a piston (300). The piston (300) is also coaxially disposed to engage between the tube (110) and the axial rod (200). The tube body portion (112) has first and second hydraulic ports (114), separated a predetermined distance from each other, through which a fluid enters and is exhausted via at least two through-holes penetrating a sidewall of the tube (110).

Figure 1:
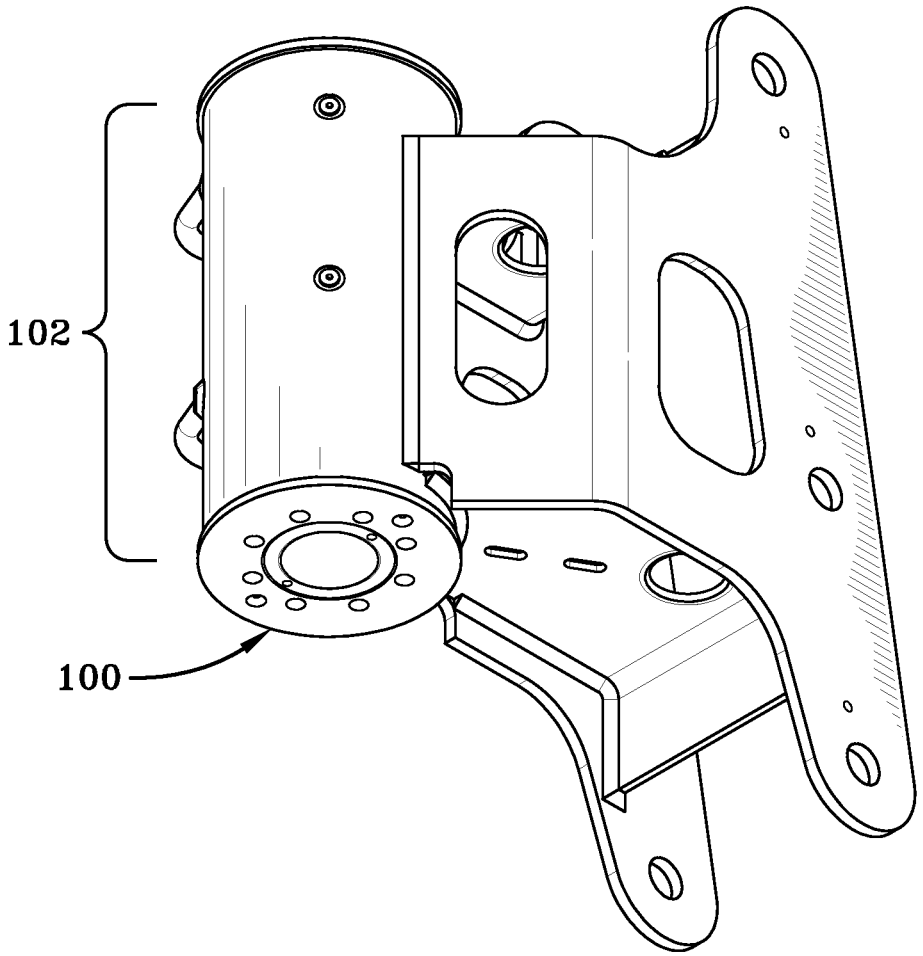
FIG. 1 is a perspective view of a rotary actuator attached to a bracket for use in practice as a platform of a special motor vehicle such as a boom used for lifting a person.
Figure 2:
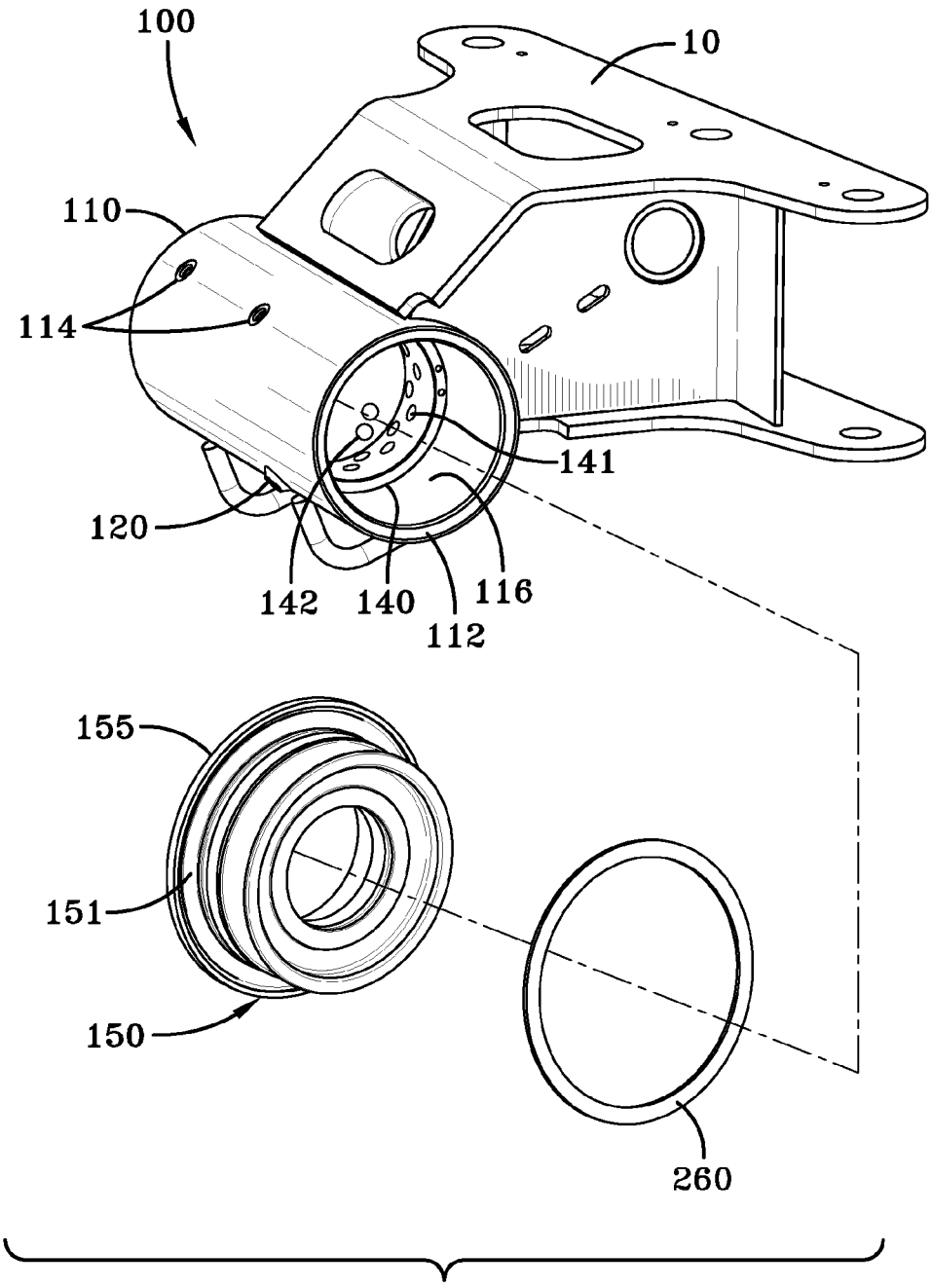
FIG. 2 is an exploded perspective view showing an attachment mechanism with a tubular body of a rotary actuator affixed thereto and an end cap with seal.

The tube (110) includes an inner circumferential surface (116) with a bearing pocket portion (140). The bearing pocket portion (140) includes at least three rows (hereinafter referred to as the "tube pocket rows (TPR)") with at least two, first spherical bearing pockets (141) per row (TPR). Each tube pocket row (TPR) is helically aligned and equally spaced a first distance about the common axis. As seen in FIG. 4B, the first end cap (150) is preferably coupled and sealed to the tube for rotation, via a first flange portion (155) extending from a first platform (151) and load bearing ring (260). With reference to FIGS. 2 and 6, a seal (160) is used to maintain hydraulic integrity inside the work enclosure (102).

As shown in FIGS. 4A-6, the piston (300) is a cylindrically shaped sleeve having a piston head (350) and a slant groove body portion (320). The piston head (350) is positioned and sealed with the tube body portion (112) for linear movement between the first and second hydraulic ports (114), thereby dividing and sealing (via intermediate seal (330)) the working enclosure (102) into two fluid chambers which can be alternately supplied with a hydraulic medium to drive the piston (300) in alternating linear directions (as described in detail below).

Figure 7:
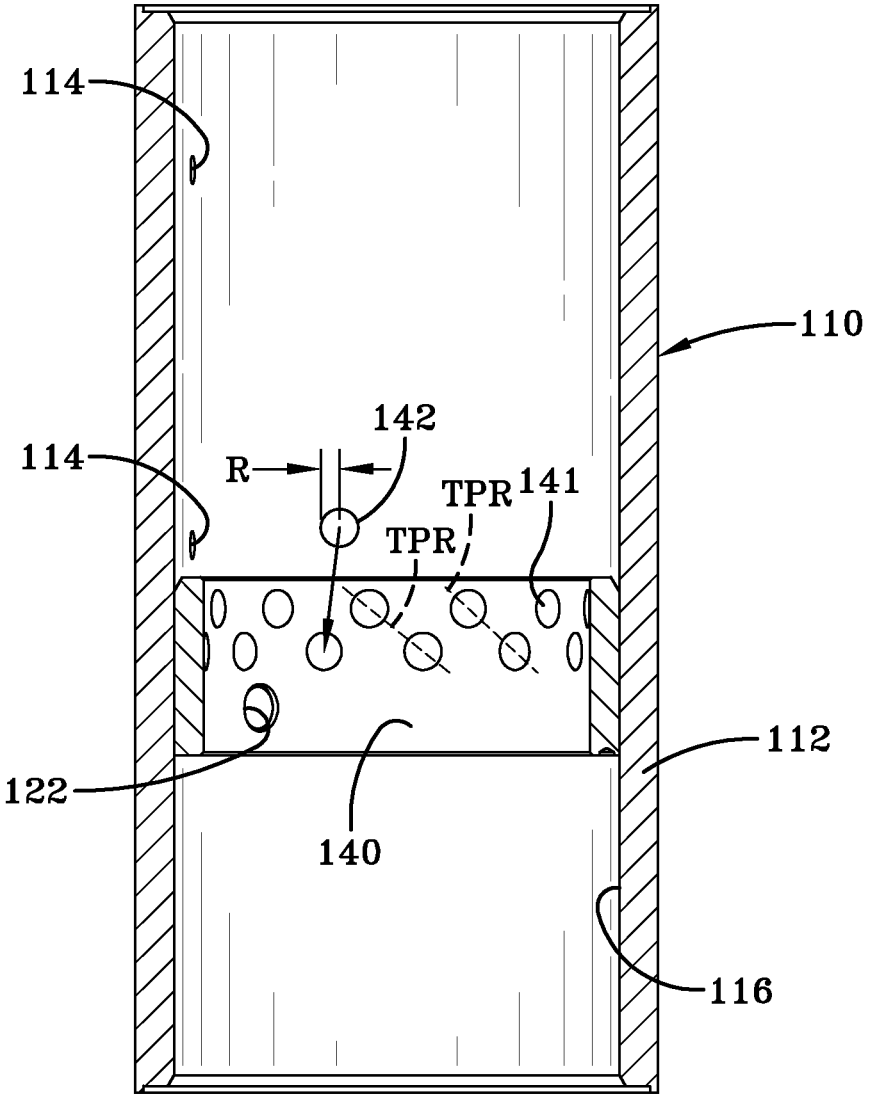
FIG. 7 is a cross-sectional view isolating the tube body portion of the tube illustrated in FIG. 6.
Figure 8:
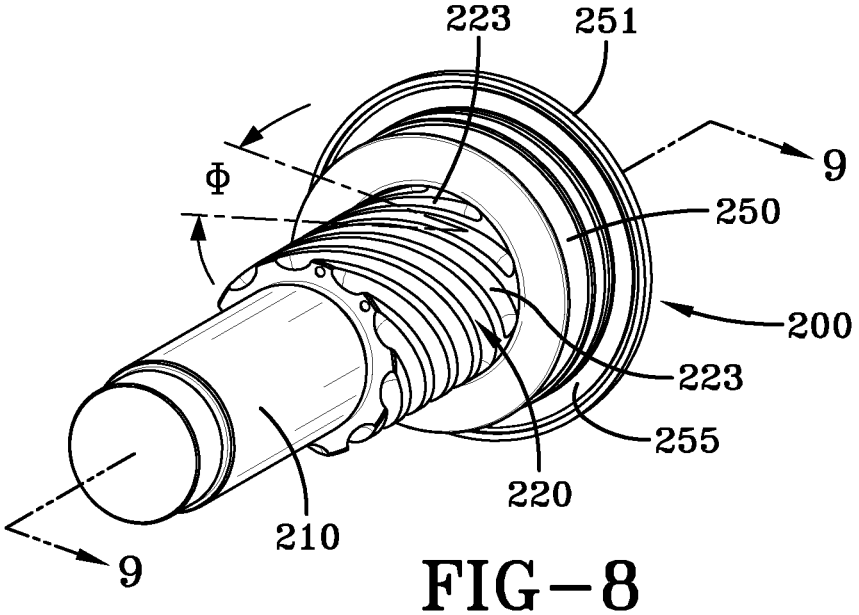
FIG. 8 is a perspective view isolating the axial rod shown in FIG. 6.
Figure 9:
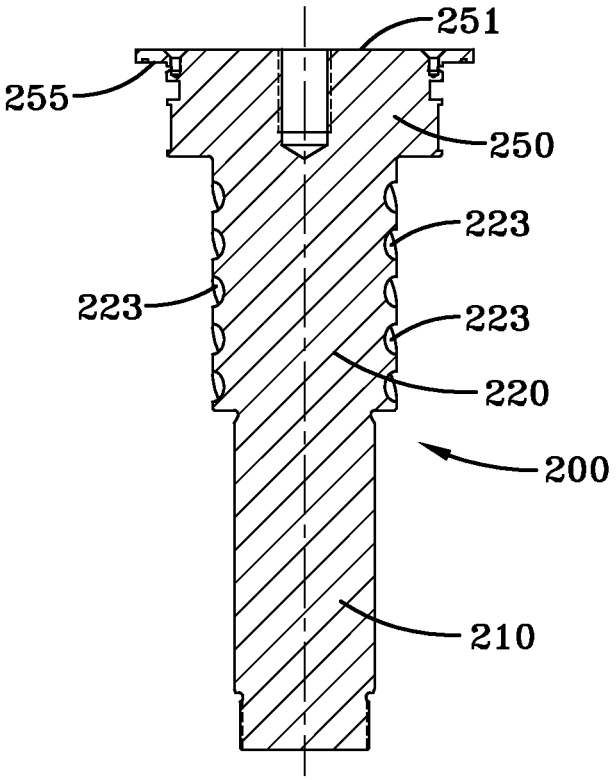
FIG. 9 is a cross-sectional view taken about lines 9-9 of FIG. 8.
Figure 10:
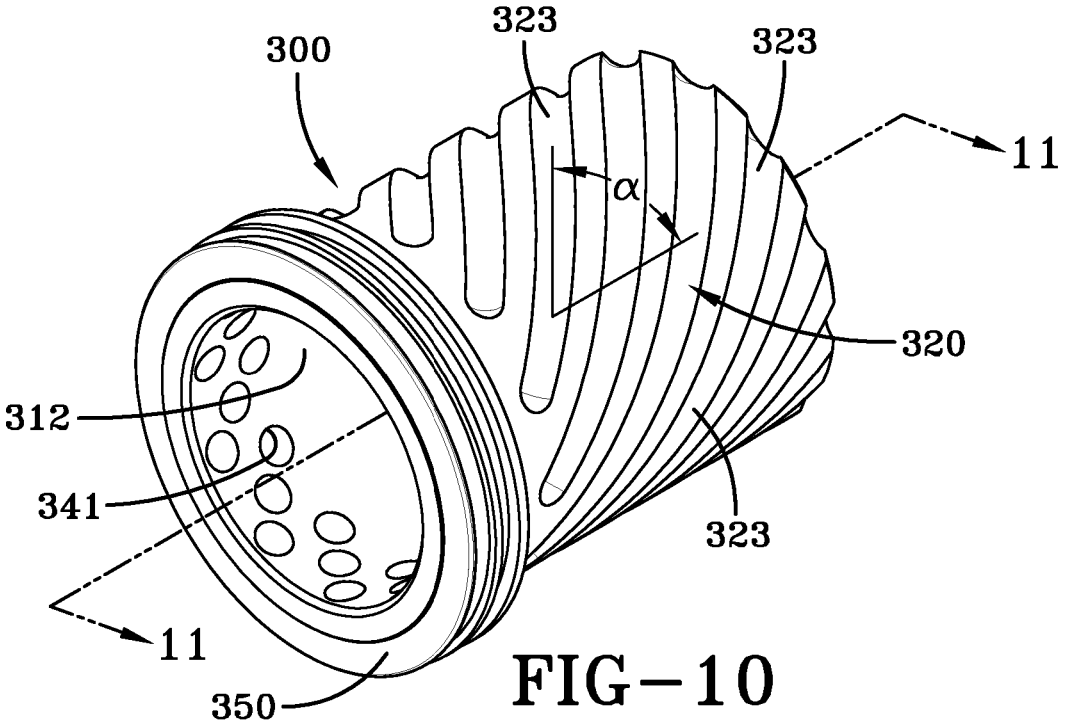
FIG. 10 is a perspective view illustrating a sleeve portion of the piston of FIG. 5.
Figure 11:
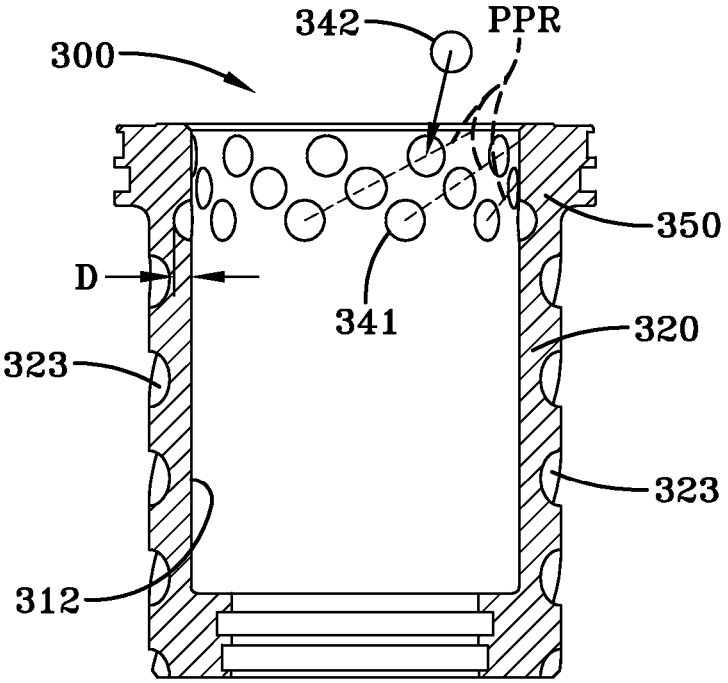
FIG. 11 is a cross-sectional view taken about lines 11-11 of FIG. 10.

The slant groove body portion (320), on an outer circumferential surface of the piston (300), includes a plurality of helical or spiral grooves (323) spaced equally about the common axis at a first distance. The helical grooves (323) are aligned in communication with a plurality of piston bearings (142) fitted in conforming mated pockets (141), preferably cut-out inside an inner collar or sleeve fixed inside the tubular body portion (112), to form a bearing pocket portion (140) as best seen in FIGS. 6 and 7. Although as less preferred alternative, the bearing pockets (142) in the bearing pocket portion (140) of the inner circumferential surface (116) of the tube (110) can be cut-out directly in the inside sidewall of the tube body portion (112).

Figure 3:
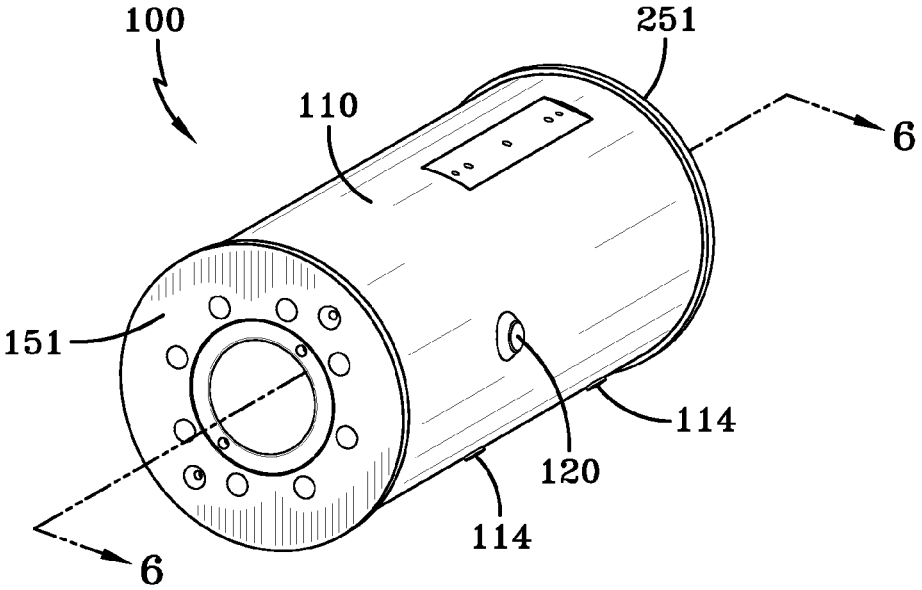
FIG. 3 generally shows an outside perspective view of the working enclosure of the rotary actuator of the instant invention.
Figure 4A:
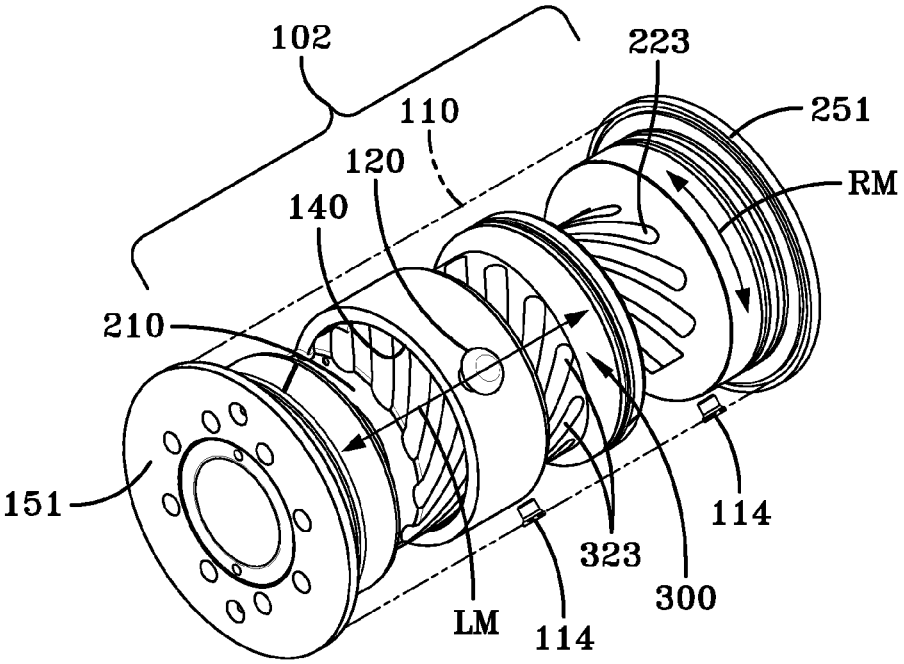
FIG. 4A is a perspective view, partially broken away, of the preferred embodiment of the actuator illustrating the inside of the working enclosure.
Figure 4B:
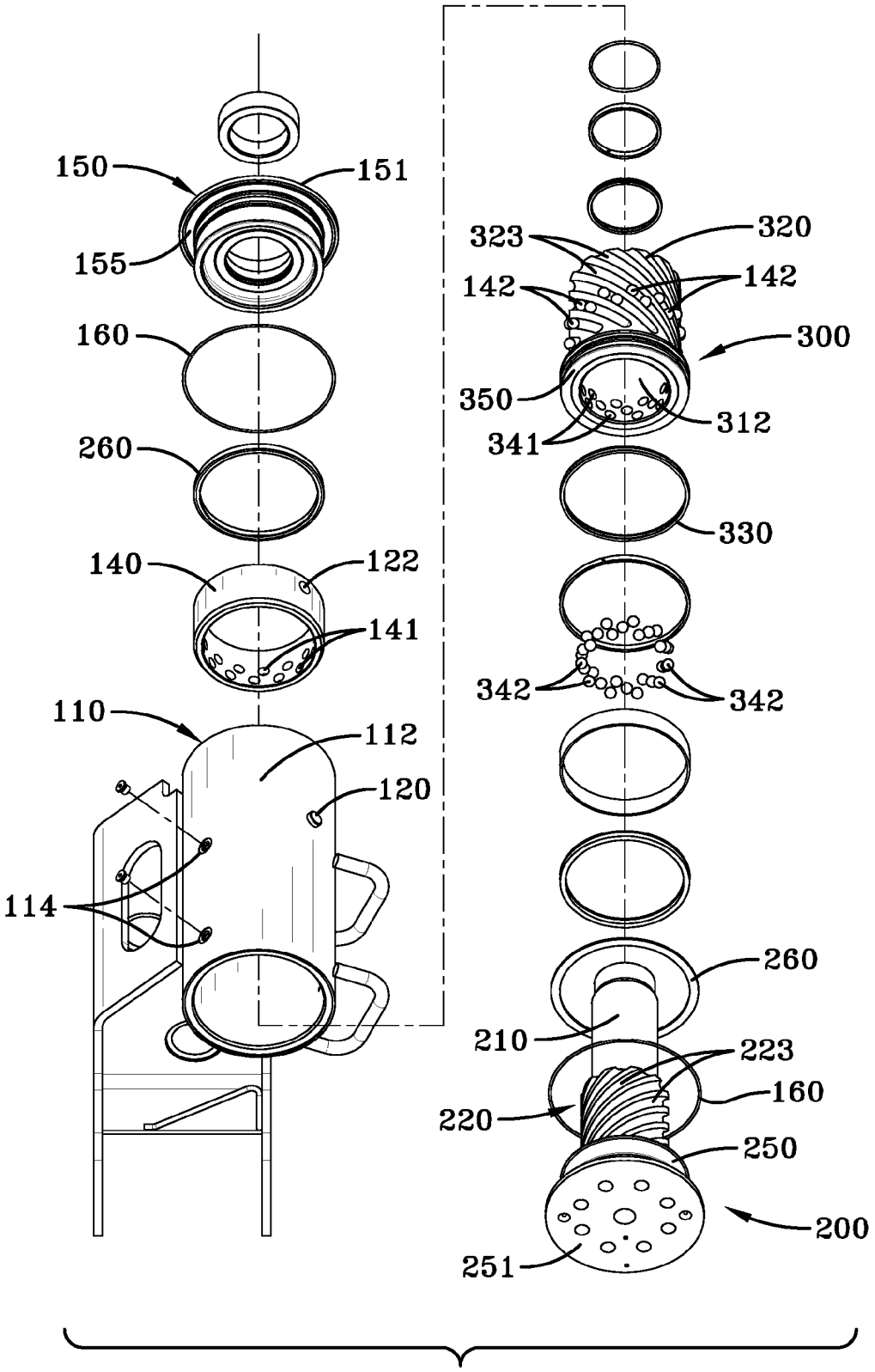
FIG. 4B is an exploded perspective view further illustrating the components of the actuator of FIG. 4A.
Figure 4C:
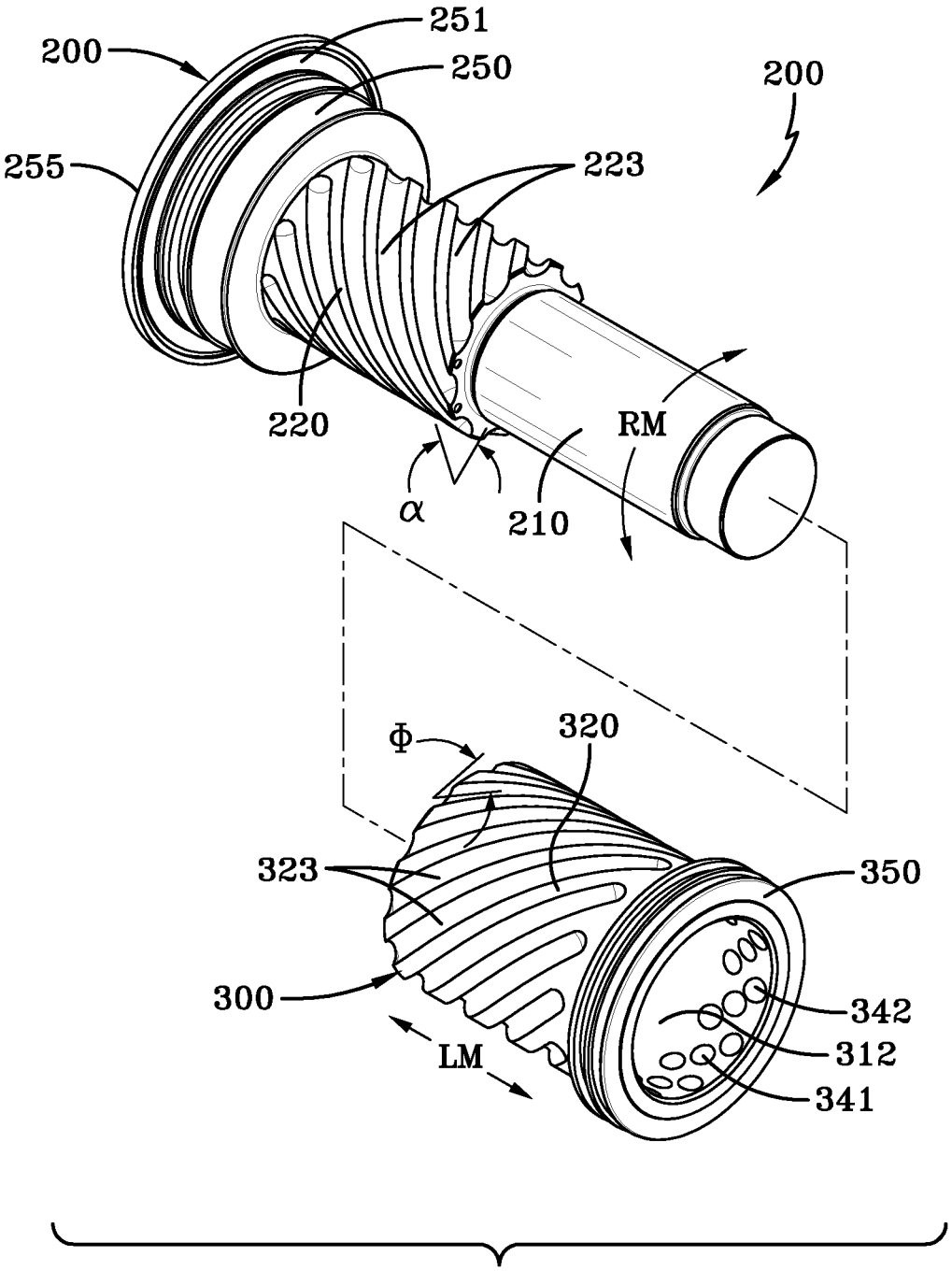
FIG. 4C is an exploded perspective view of the piston and axial rod of the actuator (i.e., without the tube body portion) to better show select features of the assembly therebetween.
Figure 5:
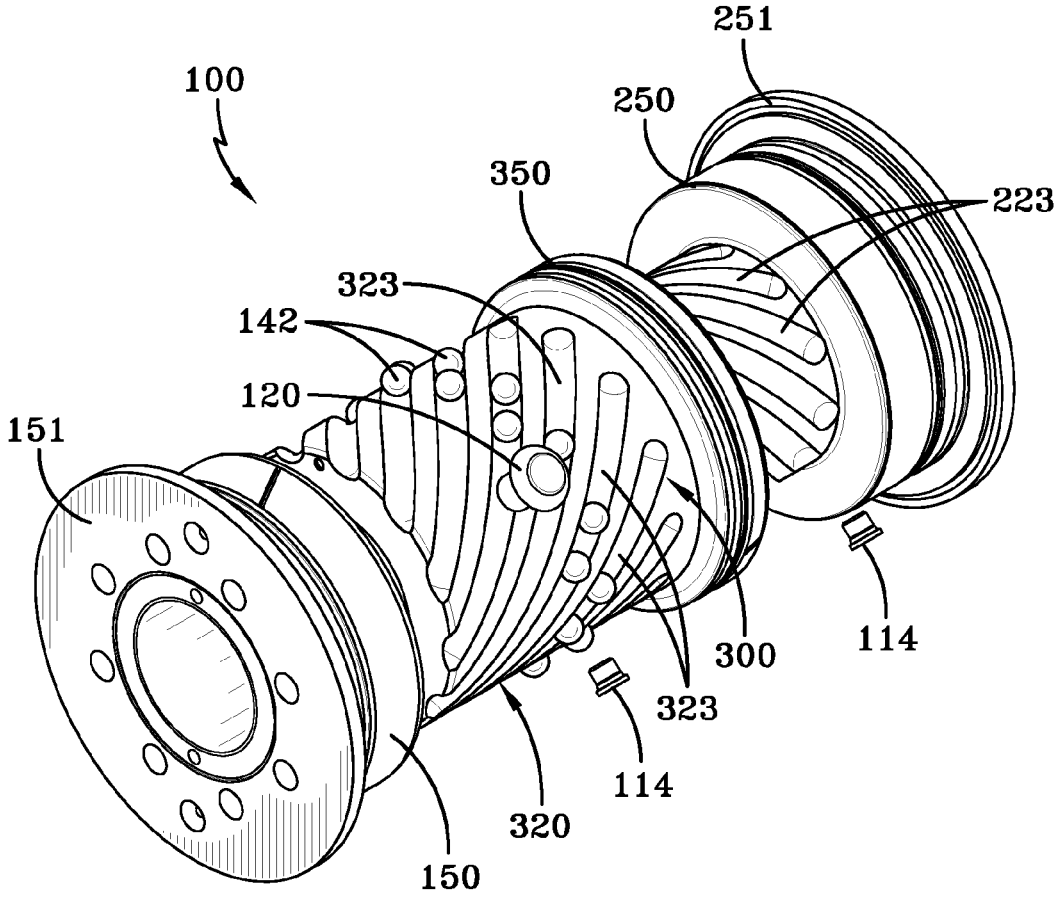
FIG. 5 is a perspective view of the assembled piston and axial rod shown in FIG. 4C to illustrate the engagement therebetween in the work chamber of the preferred embodiment of the present invention.

When the sleeve is used as the bearing pocket portion (140) as shown, it is preferably aligned and fixed inside the tube (110) by one or more pins (120) passing through a corresponding aligned opening (122) in the wall of the tube body portion (112) and sleeved bearing pocket portion (140), and is then retained therein by a fillet weld to the outside of the tube body portion (112) as illustrated in FIGS. 3 and 4A. This design is preferred over, for example, directly welding the sleeve to the inside of the tube (110) because of alignment issues and warping often caused by the heat of the welding step. Further, this design also allows for easier and more efficient replacement and/or repair of sleeved bearing pocket portion (140) that is worn.

Also, to be clear, the second spiral grooves (323) are spaced equal to the first distance of the tubular pocket rows (TPR) of the first spherical bearing pockets (141) on the inner circumferential surface (116) of the tube (110) for alignment therewith. The piston (300) further includes an inner circumferential surface (312) with a plurality of rows (hereinafter referred to as the "piston pocket rows (PPR)") with at least three, second spherical bearing pockets (341) per row (PPR). Each piston pocket row (PPR) is helically aligned and spaced from each other about the axis a distance equal to the second distance of the first spiral grooves (223) of the helical groove portion (220) of the axial rod (200), so that each piston pocket row (PPR) is correspondingly aligned and mated with one of the first spiral grooves (223).

Figure 14:
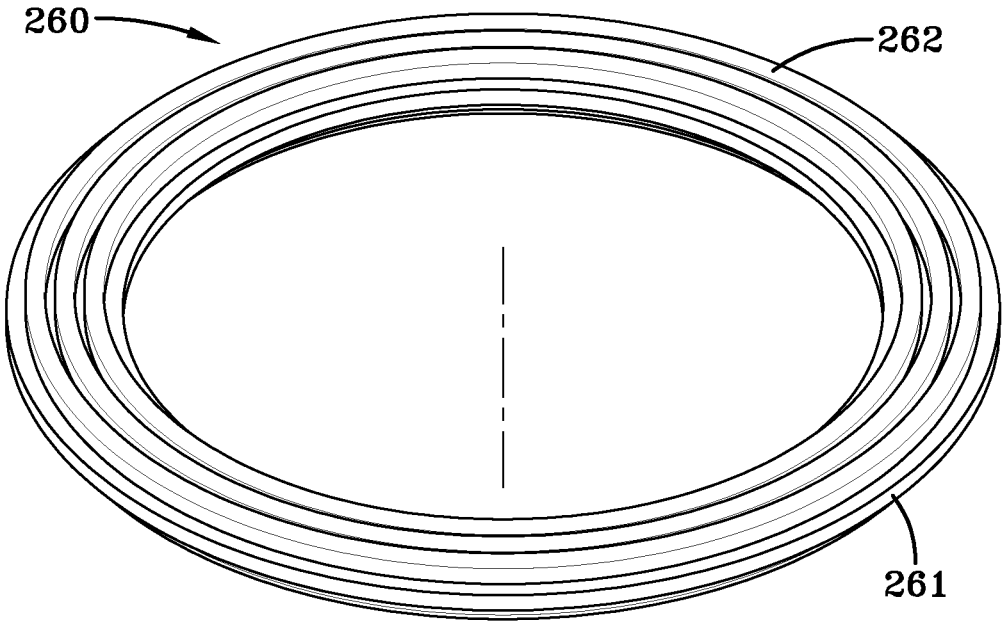
FIG. 14 is a perspective view of a load bearing ring.
Figure 15:
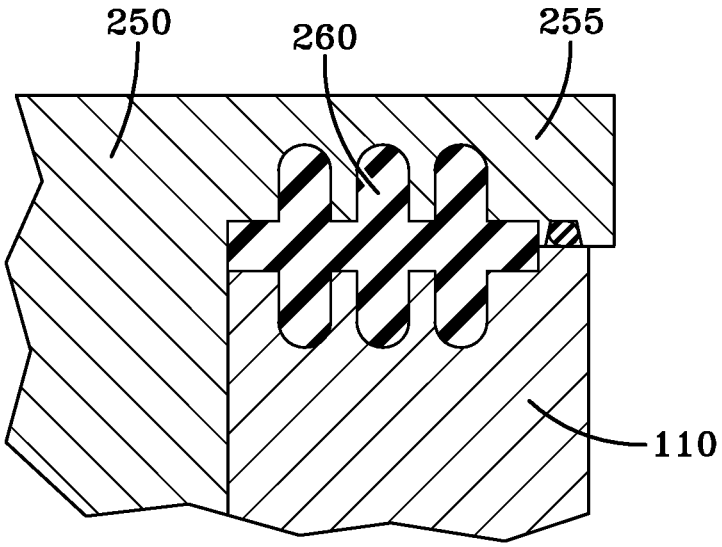
FIG. 15 is a cross-sectional view illustrating the load bearing ring of FIG. 14 engaged in place between the tube body portion and a flange portion of the end cap affixed to the axial rod.

Regarding the working enclosure (102), the axial rod (200) is preferably affixed to, or includes as one piece, the second end cap (250) having a second platform (251) and flange portion (255) disposed at an end of the tube opposite the first end cap (150). Preferably, both the first and second end caps (150, 250) are fixed to the axial rod (200). As a result, both end caps (150, 250) will rotate with the axial rod (200) relative to the tube (110). Alternatively, just the second end cap (250) can be used as the rotating platform. Whether one or both of the end caps (150, 250) rotate with the axial rod (200), load bearing rings (260) are used to handle and disperse the load between the tube body (112) and corresponding flange portions (115, 255) of the respective first and second end caps (150, 250). As best seen in FIGS. 14 and 15, the load bearing ring (260), having a ring body (261) with a plurality of ring bumpers (262), is preferably used to create a bearing surface for sliding engagement between corresponding rotating platforms (151, 251) affixed to the axial rod (200), via end caps (150, 250) and tube body portion (112) of the tube (110).

Figure 12:
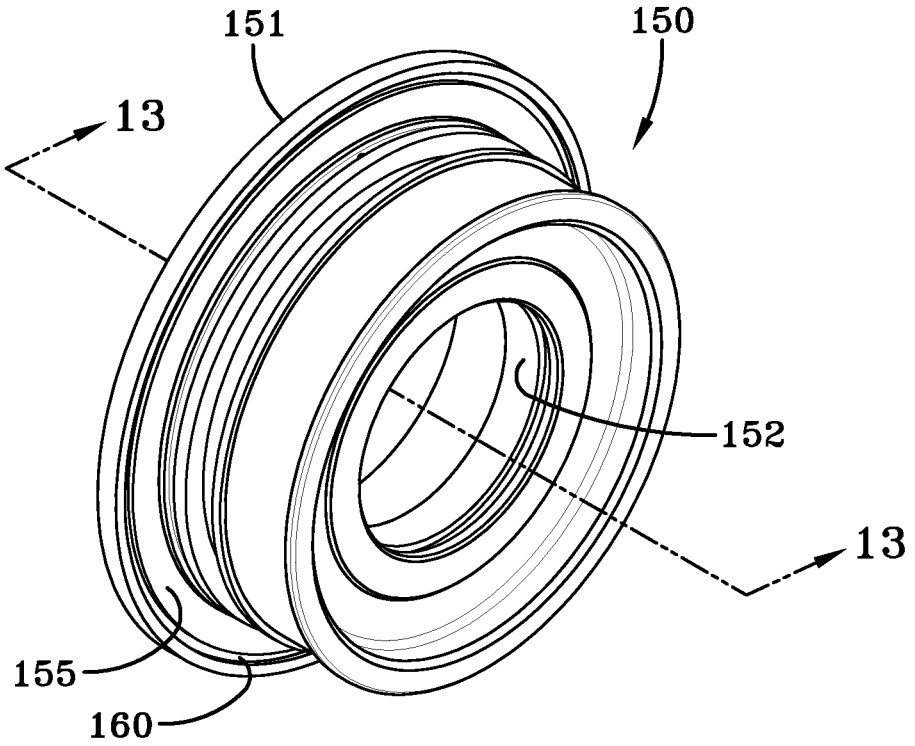
FIG. 12 is a perspective view illustrating an end cap (i.e., not permanently fixed to the axial rod) shown in FIG. 4B.
Figure 13:
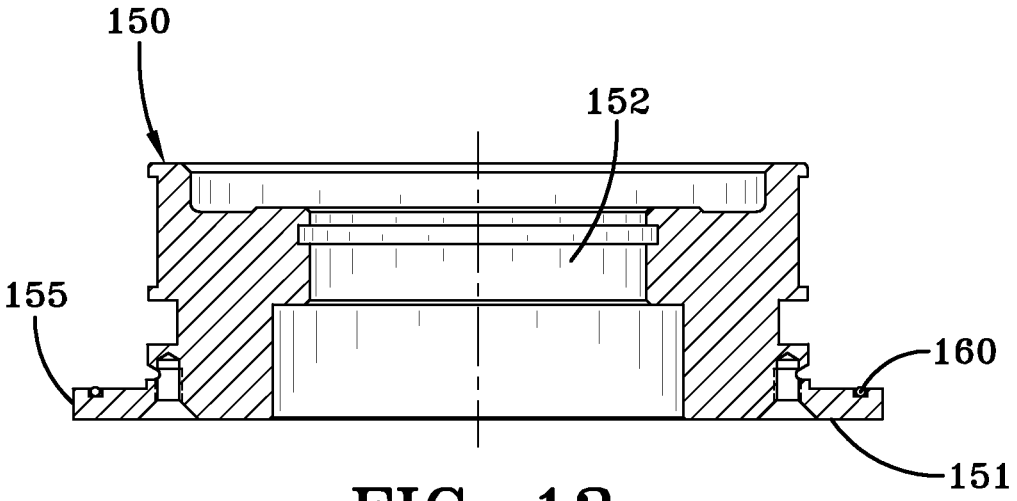
FIG. 13 is a cross-sectional view taken about the lines 13-13 of FIG. 12.

Further describing the preferred embodiment in this case, the axial rod (200) includes an outer circumferential surface having both a helical groove portion (220) and a smooth cylindrical body portion (210). The helical groove portion (220) has at least three first helical or spiral grooves (223) formed at an incline or helix opposite the second spiral grooves (323), and each spiral groove (223) is spaced equally a second distance from adjacent spiral grooves (223). If the first end cap (150) best seen in FIGS. 12 and 13, is not fixed to the axial rod (200), as alternatively described above, the smooth cylindrical body portion (210) passes through the opening (152) in the first end cap (150) and seals therewith as shown in FIG. 6, so that only the second end cap (250) rotates with the axial rod (200).

Notably, each of the first spherical bearing pockets (141) of the bearing pocket portion (140) on the inner circumferential surface (116) of the tube (110) includes one of a first set of bearings (142) for rotation therein and along the correspondingly aligned second spiral grooves (323) of the piston (300); and each of the second spherical bearing pockets (341) on the inner circumferential surface (312) of the piston (300) has a second piston bearing (342) for rotation therein and along the correspondingly aligned first spiral groove (223) of the helical groove portion (220) of the axial rod (200). As a result of the inter-engagement of the spiral grooves (223, 323) with the corresponding first and second sets of bearings (142, 342), the linear motion (LM) of the piston (300) forces the axial rod (200) to rotate in the directions shown by the arrow (RM) seen in FIG. 4A, thereby rotating the affixed end caps (150 and/or 250) and corresponding platforms (151, 251) thereto.

In operation, therefore, the hydraulic medium is alternately supplied to the fluid chambers of the working enclosure (102) to drive the piston (300) in alternating linear directions (i.e., up-an-down along the axis), which in turn causes rotation of the axial rod (200) via mated engagement of the bearings (142, 342) and corresponding grooves (223, 323). More specifically, when the hydraulic medium (such as oil) alternately enters and is exhausted through the first and second hydraulic ports (114) of the tube body portion (112), the piston (300) moves inside the tube (110). For example, when oil enters through the first hydraulic port (114) and into its corresponding fluid chamber (while being simultaneously exhausted through the second hydraulic port (114) from its respective hydraulic chamber), hydraulic pressure formed between the first and second hydraulic chambers pushes against the piston head (350) to move the piston (300) linearly toward the second hydraulic chamber. Then, when the flow is reversed, the piston (300) returns, i.e. moving it in alternating axial directions as indicated by the arrow (LM) shown in FIG. 4A.

In turn, the linear motion (LM) of the piston (300) engages the axial rod (200) and forces the axial rod (200) to rotate, as shown by arrow (RM) in FIG. 4A. Specifically, the axial rod (200) drives one or preferably both of the first and second end caps (150, 250), and ultimately their corresponding platforms (151, 252), via the spiral grooves (223) of the rotating axial rod (200) aligned in engaged communication with the second set of bearings (342) fitted in their corresponding mating pockets (341) along the inner circumferential surface (312) of the reciprocating piston (300).

As previously stated, the helix directions of the first and second spiral grooves (223, 323), respectively, are formed to be opposite each other. Thus, due to the coupling engagement described above (i.e., between the second piston bearings (342) with the second spherical bearing pockets (341) and first tube bearings (142) with the first spherical bearing pockets (141), mated with the corresponding spiral grooves (223, 323)), when the piston (300) moves laterally, the piston (300) is rotated at an angle $\alpha$ with respect to the tube (110). In turn, when the piston (300) moves and is rotated, the axial rod (200) rotates at the angle $\phi$ of the first spiral grooves (223) with respect to the piston (300). Moreover, as the piston (300) moves, the rotational angle of the axial rod (200) with respect to the tube (110) is $\alpha$ plus $\phi$.

As a result, the rotation angle of the axial rod (200), and, in effect, the platforms (151, 251) of the first and second end caps (150, 250), can be instantaneously changed with respect to shorter or longer piston linear motion distances due to the pinpoint rotational motion of the first and second bearings (142, 342) in their corresponding pockets (141, 341) along their respective spiral grooves (323, 223). Moreover, the degree of rotation of the first and second platforms (151, 251) affixed to the axial rod (200) and, as a result, the torque of the actuator can be designed by simply changing either or both of the slant angles (0 and cc) of the first and second spiral grooves (223, 323) of the rotary actuator (100).

While this invention has been particularly shown and described with reference to preferred embodiments thereof, it will be understood by those in the field of the art that various changes in form and detail may be made therein without departing from the spirit and scope of the invention as defined by the appended claims.

What is claimed is:

1. A rotary actuator comprising:

a tube having first and second hydraulic ports with through-holes penetrating a side wall of a tube body portion having first and second ends, the ports being separated a predetermined distance from each other and through which a fluid enters and is exhausted, the tube having a sleeve fixed inside the tube body portion between the first and second ends by a pin passing through a corresponding opening in the side wall of the tube, the sleeve includes an inner circumferential surface with a bearing pocket portion having a plurality of first spherical bearing pockets aligned in tube pocket rows with each tube pocket row helically aligned and equally spaced a first distance;

a first end cap coupled with the first end of the tube;

an axial rod having a second end cap disposed at the second end of the tube forming a platform to be rotated by the axial rod, the axial rod also having an outer circumferential surface with a helical groove portion and a smooth cylindrical body portion, the helical groove portion having at least three first spiral grooves with each being spaced a second distance, and the smooth cylindrical body portion being coupled with the first end cap; and a piston disposed between the tube body portion and the axial rod, the piston having a piston head and a slant groove body portion on an outer circumferential surface, wherein at least three second spiral grooves are formed on said outer circumferential surface of the slant groove body portion having a helical direction opposite the first spiral grooves and each being spaced equal to the first distance of the tube pocket rows of the inner circumferential surface of the tube for alignment therewith, and the piston also having an inner circumferential surface with at least three helically aligned rows of second spherical bearing pockets with each helical piston pocket row being spaced equal to the second distance of the first spiral grooves of the helical groove portion of the axial rod for alignment therewith; and wherein each of the first spherical bearing pockets of the bearing pocket portion on the inner circumferential surface of the sleeve fixed to the inside of the tube having a first bearing for rotation therein and along the correspondingly aligned second spiral groove of the piston, and each of the second spherical bearing pockets on the inner circumferential surface of the piston having a second piston bearing for rotation therein and along the correspondingly aligned first spiral groove of the helical groove portion of the axial rod.

2. A rotary actuator comprising:

a tube having first and second hydraulic ports with through-holes penetrating a side wall of the tube in a tube body portion, the ports being separated a predetermined distance from each other and through which a fluid enters and is exhausted, the tube having a sleeve secured to an inside of the tube body portion between first and second ends of the tube by a pin passing through an opening in the side wall of the tube, the sleeve includes an inner circumferential surface with a bearing pocket portion having at least two first spherical bearing pockets aligned in one of a plurality tube pocket rows helically aligned and equally spaced a first distance about an axis;

a first end cap coupled at a first end of the tube;

an axial rod having a second end cap disposed at a second end of the tube opposite the first end cap forming a platform to be rotated by the axial rod, the axial rod also having an outer circumferential surface with a helical groove portion and a smooth cylindrical body portion, the helical groove portion having at least three first spiral grooves equally spaced a second distance, the smooth cylindrical body portion being rotatably coupled through the first end cap; and a piston disposed between the tube and the axial rod, the piston having a piston head and a slant groove body portion on an outer circumferential surface, wherein a plurality of second spiral grooves are formed on said outer circumferential surface of the slant groove body portion having a helical direction opposite the first spiral grooves and being spaced equal to the first distance of the tube pocket rows of the inner circumferential surface of the tube for alignment therewith, and the piston also having an inner circumferential surface with at least three helically aligned rows of second spherical bearing pockets and each helical piston pocket row is spaced equal to the second distance of the first spiral grooves of the helical groove portion of the axial rod for alignment therewith; and wherein each of the first spherical bearing pockets of the bearing pocket portion on the inner circumferential surface of the sleeve inside the tube have a first bearing for rotation therein and along the correspondingly aligned second spiral groove of the piston, and each of the second spherical bearing pockets on the inner circumferential surface of the piston having a second piston bearing for rotation therein and along the correspondingly aligned first spiral groove of the helical groove portion of the axial rod.

3. The rotary actuator of claim 2, wherein the pin securing the sleeve to the tube body portion is secured by a fillet weld of the pin to an outside of the tube body portion.

4. The rotary actuator of claim 2, wherein each of the first spherical bearing pockets of the tube has a depth greater than a radius of the corresponding first bearing mated therewith.

5. The rotary actuator of claim 2, wherein each of the second spherical bearing pockets of the piston has a depth greater than a radius of the corresponding second bearing mated therewith.

6. The rotary actuator of claim 2, wherein the first spiral grooves of the helical groove portion of the axial rod include first and second end sections, a middle section, and a helical angle of the middle section greater than a helical angle of the end sections.

7. The rotary actuator of claim 2, wherein each of the at least three helically aligned rows of the second spherical bearing pockets in the inner circumferential surface of the piston include at least three bearing pockets.

* * * * *